US006279766B1

(12) United States Patent
Jones et al.

(10) Patent No.: US 6,279,766 B1
(45) Date of Patent: Aug. 28, 2001

(54) SAFETY CLOSURE WITH TAMPER-RESISTANT LOCKING TAB AND METHOD AND APPARATUS FOR MAKING SAME

(75) Inventors: Narda A. Jones, Evansville; Todd E. Mathes, Newburgh; Jeffrey C. Minnette, Evansville; Gary V. Montgomery, Evansville; William J. Shankland, Evansville, all of IN (US)

(73) Assignee: Rexam Medical Packaging Inc., Evansville, IN (US)

( * ) Notice: Subject to any disclaimer, the term of this patent is extended or adjusted under 35 U.S.C. 154(b) by 0 days.

(21) Appl. No.: 09/371,308

(22) Filed: Aug. 10, 1999

(51) Int. Cl.[7] ..... B65D 55/02
(52) U.S. Cl. ..... 215/219; 215/252; 215/216
(58) Field of Search ..... 215/252, 250, 215/216–220, 305, 330

(56) References Cited

U.S. PATENT DOCUMENTS

| | | | | |
|---|---|---|---|---|
| 3,182,840 | * | 5/1965 | Polzin . | |
| 3,233,769 | * | 2/1966 | Jessop | 215/217 X |
| 3,445,022 | * | 5/1969 | Cilluffo . | |
| 3,651,185 | | 3/1972 | Monkel . | |
| 3,759,652 | | 9/1973 | Childs et al. . | |
| 3,989,152 | * | 11/1976 | Julian | 215/217 X |
| 4,019,711 | | 4/1977 | Altenhof et al. . | |
| 4,099,903 | | 7/1978 | Petrov . | |
| 4,103,797 | | 8/1978 | Morris . | |
| 4,155,698 | | 5/1979 | Aichinger . | |
| 4,177,906 | * | 12/1979 | Von Hagel | 215/329 X |
| 4,180,175 | * | 12/1979 | Virog, Jr. et al. | 215/252 |
| 4,261,478 | * | 4/1981 | Summers | 215/252 X |
| 4,299,371 | | 11/1981 | Duga . | |
| 4,331,247 | * | 5/1982 | Mumford | 216/216 |
| 4,340,352 | | 7/1982 | Hayberg . | |
| 4,346,811 | | 8/1982 | Hilaire . | |
| 4,427,124 | | 1/1984 | Marshall et al. . | |
| 4,457,437 | * | 7/1984 | Heath, Jr. | 216/252 X |
| 4,496,302 | | 1/1985 | Brown . | |
| 4,519,569 | | 5/1985 | Nolan . | |
| 4,572,385 | * | 2/1986 | Luker | 215/216 |
| 4,865,209 | | 9/1989 | Bush . | |
| 4,917,846 | | 4/1990 | Takase et al. . | |
| 4,983,346 | | 1/1991 | Curliss et al. . | |
| 5,040,692 | | 8/1991 | Julian . | |
| 5,049,344 | | 9/1991 | Sorensen . | |
| 5,114,659 | | 5/1992 | Krall . | |
| 5,230,856 | | 7/1993 | Schellenbach . | |
| 5,289,932 | * | 3/1994 | Dimeo et al. | 215/232 X |
| 5,360,126 | * | 11/1994 | Snyder et al. | 215/252 |
| 5,368,469 | | 11/1994 | Ekkert . | |
| 5,379,910 | | 1/1995 | Montgomery . | |
| 5,462,182 | * | 10/1995 | Opresco | 215/217 X |
| 5,556,651 | | 9/1996 | Watanabe et al. . | |
| 5,706,962 | | 1/1998 | Tauber . | |
| 5,779,072 | | 7/1998 | Krebs . | |
| 5,979,681 | * | 11/1999 | Varlet et al. | 215/252 X |
| 5,992,657 | * | 11/1999 | Friedman | 215/252 X |
| 6,016,930 | * | 1/2000 | Mathes et al. | 215/252 X |
| 6,036,036 | * | 3/2000 | Bilani et al. | 215/219 X |
| 6,039,196 | * | 3/2000 | Ekkert et al. | 215/216 |
| 6,076,689 | * | 6/2000 | Vassallo | 215/218 X |

* cited by examiner

*Primary Examiner*—Allan N. Shoap
*Assistant Examiner*—Robin A. Hylton
(74) *Attorney, Agent, or Firm*—John F. Salazar; Middleton & Reutlinger

(57) ABSTRACT

A safety closure including a top wall, a side wall depending from the top wall, and a locking tab projecting outwardly from the side wall, the locking tab having a reinforced end integrally connected to the side wall and a free end connected to the side wall by a biasing strap, wherein the reinforced end of the locking tab inhibits movement of the free end of the locking tab in at least an upward direction.

9 Claims, 11 Drawing Sheets

SAFETY CLOSURE WITH TAMPER-RESISTANT LOCKING TAB AND METHOD AND APPARATUS FOR MAKING SAME

BACKGROUND OF THE INVENTION

1. Technical Field of the Invention

The present invention relates to safety closures for use on containers. More particularly, the present invention relates to a safety closure for use on a container, wherein the safety closure and the container are each provided with locking means which cooperate to inhibit access to the container by an individual of tender years, and wherein the safety closure locking means is reinforced to resist tampering therewith.

2. Description of the Related Art

It is known in the prior art to affix a closure to a container over a dispensing orifice thereof to prevent unwanted spillage of the contents of the container therefrom. It is also known in the prior art for the closure to be provided with locking means, wherein the closure locking means are engageable with locking means provided on the container to inhibit removal of the closure from the container by an individual of tender years, and to inhibit access of the container contents by the individual thereby. Thus, it is desirable to provide a safety closure for use on a container, wherein the safety closure is provided with locking means, wherein the closure locking means are engageable with locking means provided on the container to inhibit removal of the safety closure from the container.

For example, U.S. Pat. No. 4,572,385 to Luker teaches a child-resistant closure threadingly affixable onto a container neck portion, wherein the closure includes an inwardly-deflectable tab which seats behind a lock abutment provided on the container when the closure is fully threaded onto the container neck portion. The engagement of the tab and the lock abutment inhibits unthreading of the closure therefrom without the user's first unseating the tab from the lock abutment. The user removes the closure from the container by squeezing the tab towards the closure a sufficient distance such that the tab is permitted to pass inwardly of the lock abutment when the user unthreads the safety closure from the container. However, tabs typically provided on safety closures of this type are oftentimes susceptible to permanent deformation thereto as a result of the user's tampering with or otherwise bending the tab outwardly away from the closure. In many cases, permanently deforming the locking tab defeats the locking functionality thereof altogether. Thus, it is furthermore desirable to provide a safety closure having a locking tab with a reinforced portion, wherein the locking tab is not susceptible to permanent damage thereto caused by the user's tampering therewith.

It is also known in the prior art to provide a closure having tamper-indicating means provided thereon. For example, U.S. Pat. No. 5,040,692 to Julian teaches a closure having a tamper-indicating band detachably molded therewith which remains affixed to a container neck portion to which the closure has been threadingly affixed even after the closure has been removed from the container a first time, thereby providing evidence that the container has been opened at least a first time. However, it is furthermore desirable to provide a safety closure for use on a container, wherein the safety closure includes a deflectable reinforced locking tab and a tamper-indicating band. It is even furthermore desirable to provide a method and apparatus for making a safety closure for use on a container, wherein the safety closure includes a deflectable reinforced locking tab and a tamper-indicating band.

It is also desirable to provide a method and apparatus for forming a safety closure for use on a container, wherein the safety closure includes a deflectable reinforced locking tab, and wherein distortion of the locking tab during forming thereof is minimized.

SUMMARY OF THE INVENTION

The present invention is for a safety closure for use on a container to inhibit access to the contents of the container by an individual of tender years. The safety closure includes a deflectable reinforced locking tab which engages a cooperating lock abutment provided on the container, thereby preventing unthreading of the closure relative to the container without first deflecting the locking tab towards the safety closure body to overcome the container lock abutment.

The safety closure includes a cap body having a top and a side wall depending downwardly from an outer perimeter of the side wall. An internal thread is provided on an interior surface of the side wall for threadingly engaging an external thread provided on a neck portion of the container. A resilient locking tab is integrally-molded with the side wall and includes an anchored end thereof connected to the side wall at at least two locations thereon and a free end connected to the side wall by a biasing strap. The free end of the locking tab is biased in a first, normally-outward position for engaging a cooperating lock abutment provided on the container neck portion upon threading the safety closure onto the container neck portion a sufficient distance. Engagement of the safety closure locking tab with the container neck portion lock abutment, then, prevents unthreading of the safety closure from the container.

The free end of the locking tab may be deflected, for example, by the user's squeezing the free end of the locking tab inwardly towards the cap body between the user's thumb and fingers. The free end of the locking tab is thereby movable towards the cap body about the anchored end of the locking lug, against the outward bias of the biasing strap, thereby permitting the locking tab to overcome and pass inward of the lock abutment upon unthreading the safety closure from the container and removal therefrom. Once the safety closure has been unthreaded a sufficient distance such that the locking tab is no longer engageable with the container lock abutment, the user may cease squeezing the free end of the locking tab inwardly, at which point, the biasing strap returns the free end of the locking tab to the first position.

As stated above, the anchored end of the locking tab is connected to the side wall at at least two locations thereon, and preferably, at the proximal end thereof and also at a location spaced from the proximal end thereof a predetermined distance towards the free end thereof but not beyond a midpoint of the locking tab. The anchored end of the locking tab may be integral with the side wall at all locations between the first and second connection locations, thereby further reinforcing the locking tab against deformation.

It is an object of the present invention to provide a safety closure for use on a container, wherein the safety closure is provided with locking means, wherein the closure locking means are engageable with locking means provided on the container to inhibit removal of the safety closure from the container.

It is another object of the present invention to provide a safety closure having a locking tab with a reinforced portion, wherein the locking tab is not susceptible to permanent damage thereto caused by the user's tampering therewith.

It is also an object of the present invention to provide a method and apparatus for making a safety closure for use on a container, wherein the safety closure includes a deflectable reinforced locking tab and a tamper-indicating band.

It is yet another object of the present invention to provide a method and apparatus for forming a safety closure for use on a container, wherein the safety closure includes a deflectable reinforced locking tab, and wherein distortion of the locking tab during forming thereof is minimized.

A safety closure according to a preferred embodiment of the present invention includes a top wall, a side wall depending from the top wall, and a locking tab projecting outwardly from the side wall, the locking tab having a reinforced end integrally connected to the side wall and a free end connected to the side wall by a biasing strap, wherein the reinforced end of the locking tab inhibits movement of the free end of the locking tab in at least an upward direction.

A method of making the safety closure according to the preferred embodiment of the present invention includes providing a mold for forming the safety closure therein, the mold including an outer die having a closure-forming cavity and a tab-forming cavity being in communication with the closure-forming cavity and being spaced outwardly therefrom, an inner core being receivable within the closure-forming cavity of the outer die, and a hold-down pin slidingly passing through the outer die adjacent the tab-forming cavity, wherein a lower end of the hold-down pin is flush with the tab-forming cavity when the outer die is in a closed posit ion, and wherein the lower end of the hold-down pin projects into the tab-forming cavity when the outer die is in an open position, positioning the inner core within the outer die to define a closure-forming chamber therebetween, interposing fluid closure-forming material into the closure-forming chamber, permitting the closure-forming material to solidify, and withdrawing the outer die from around the inner core, wherein the hold-down pin abuts the locking tab of the closure and urges the locking tab out of the tab-forming cavity.

An apparatus for making the safety closure according to the preferred embodiment of the present invention includes an outer die having a closure-forming cavity and a tab-forming cavity being in communication with the closure-forming cavity and being spaced outwardly therefrom, the outer die being reciprocally moveable between a closed position and an open position, an inner core being receivable within the closure-forming cavity of the outer die, and a hold-down pin slidingly passing through the outer die adjacent the tab-forming cavity, wherein a lower end of the hold-down pin is flush with the tab-forming cavity when the outer die is in the closed position, and wherein the lower end of the hold-down pin projects into the tab-forming cavity when the outer die is in the open position.

BRIEF DESCRIPTION OF THE DRAWINGS

A better understanding of the present invention will be had upon reference to the following description in conjunction with the accompanying drawings in which like numerals refer to like parts, and wherein.

DETAILED DESCRIPTION OF THE PREFERRED EMBODIMENTS

Figure 1:
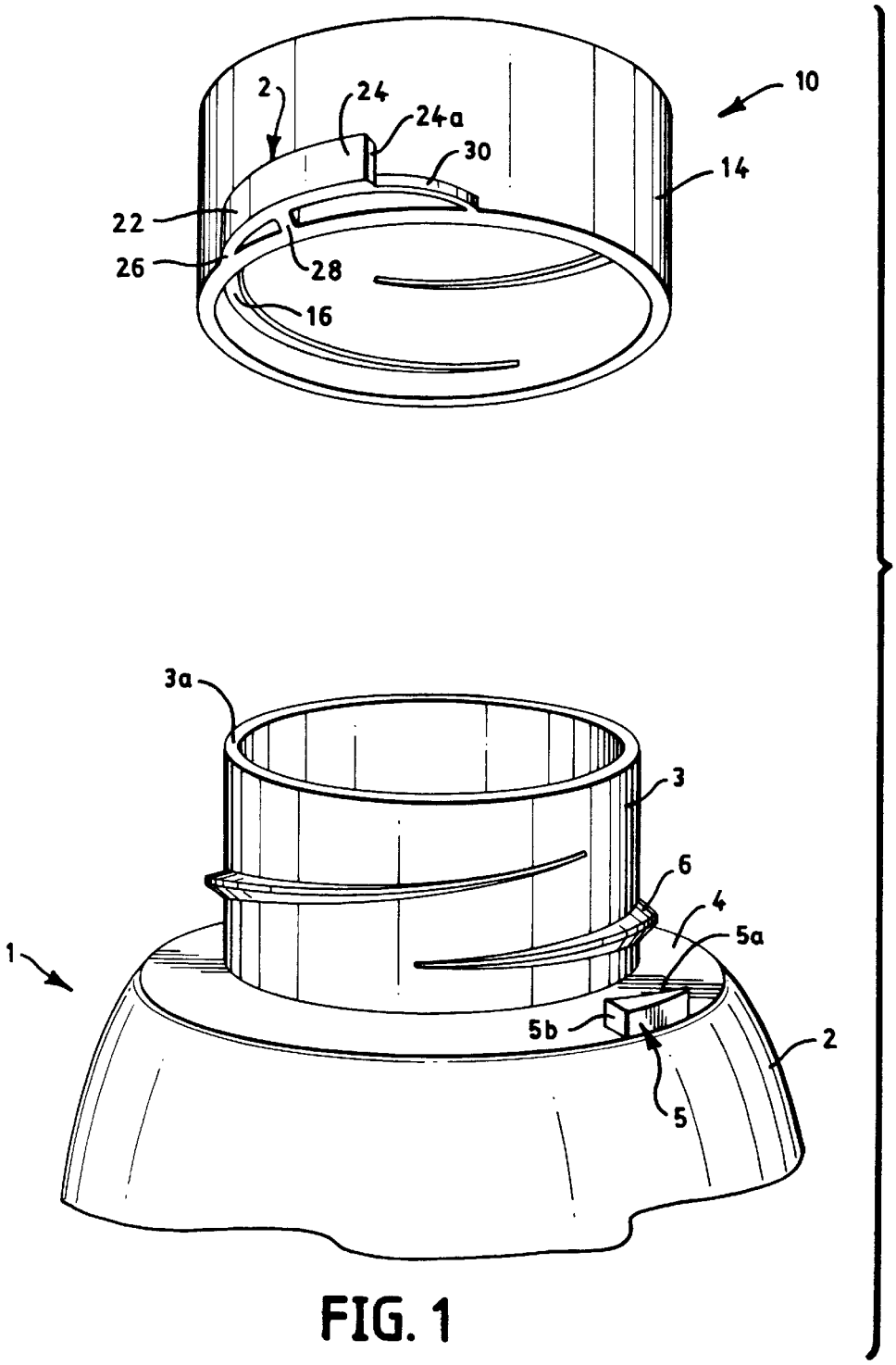
FIG. 1 is a perspective view of a safety closure according to a preferred embodiment of the present invention shown in spaced relation to a neck portion of a container.

With reference to FIG. 1, a safety closure 10 according to a preferred embodiment of the present invention for use on a container 1 is shown in spaced relation to the container 1. The container 1 is preferably injection-molded polyethylene or polypropylene, and includes a hollow body 2 and a neck portion 3 connected to the body 2 by a shoulder 4. The body 2 defines a cavity therein for receiving and storing contents, such as pills, tablets, capsules, or the like, therein. The neck portion 3 includes an open upper end which communicates with the body cavity, through a passageway in the neck portion 3, to permit filling and dispensing of the contents from the container 1. A lock abutment 5 is provided on the shoulder 4 spaced outwardly from the neck portion 3 and includes a leading, ramped face 5*a* and a trailing, abutment face 5*b*.

The safety closure 10 includes a top 12 (FIG. 2), a side wall 14 depending downwardly from an outer perimeter of the top 12, and a locking tab 20 extending outwardly from the side wall 14. The side wall 14 includes an internal thread 16 provided on an inner surface thereof which is threadingly engageable with an external thread 6 provided on an outer surface of the container neck portion 3. The safety closure 10 is thereby threadingly affixable to the container 1 to prevent spillage or unwanted dispensing of the contents.

Figure 3:
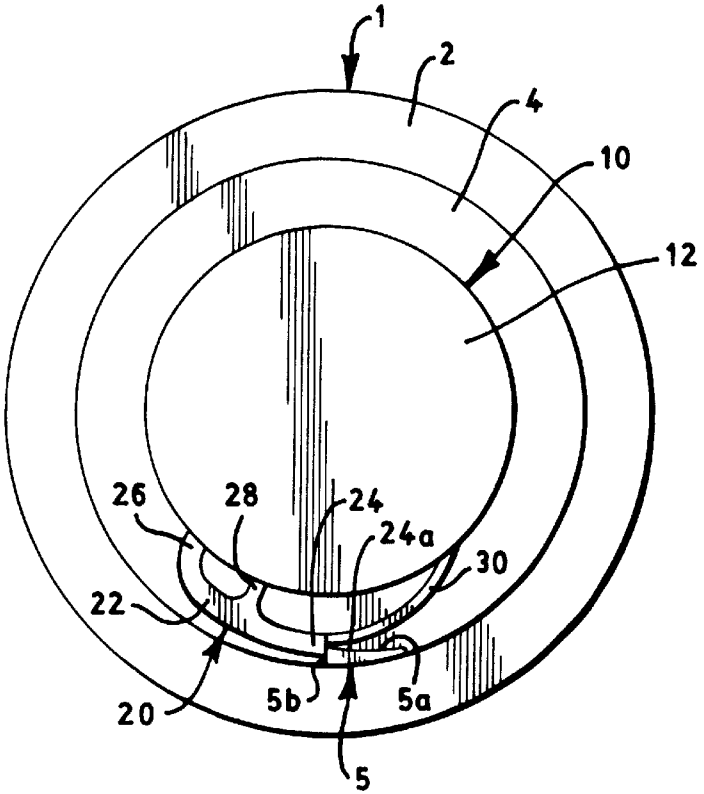
FIG. 3 is a top view of the safety closure and container neck portion of FIG. 1, wherein the safety closure is shown in a locked, fully-threaded, position on the container neck portion.
Figure 2:
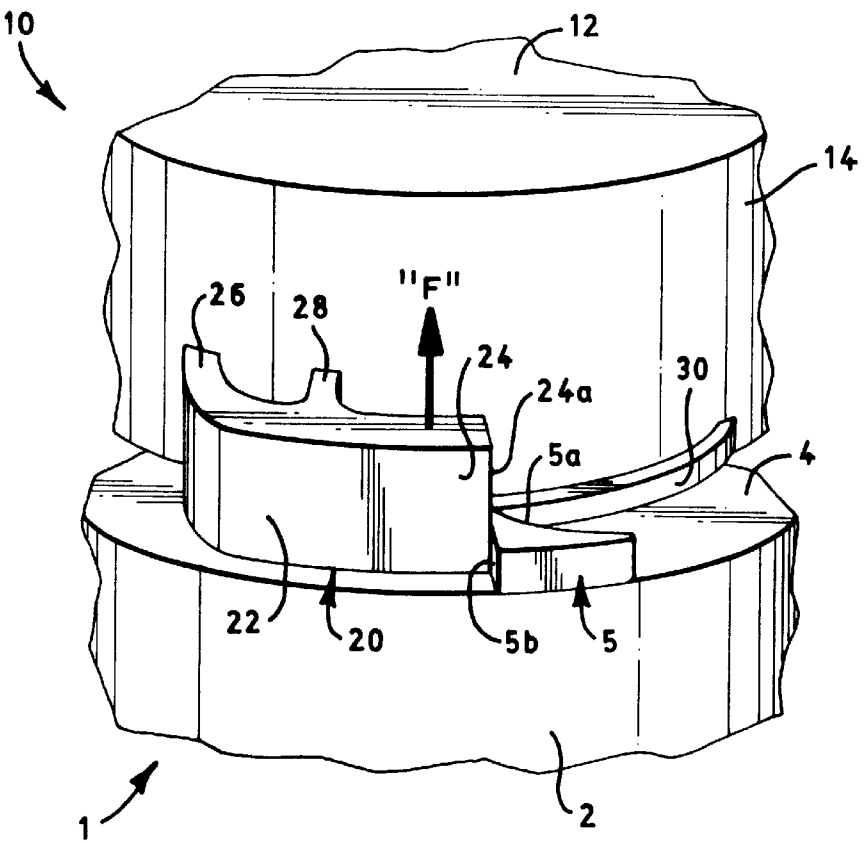
FIG. 2 is a fragmentary perspective view of the safety closure and container neck portion of FIG. 1, wherein the safety closure is shown in a locked, fully-threaded, position on the container neck portion.
Figure 5:
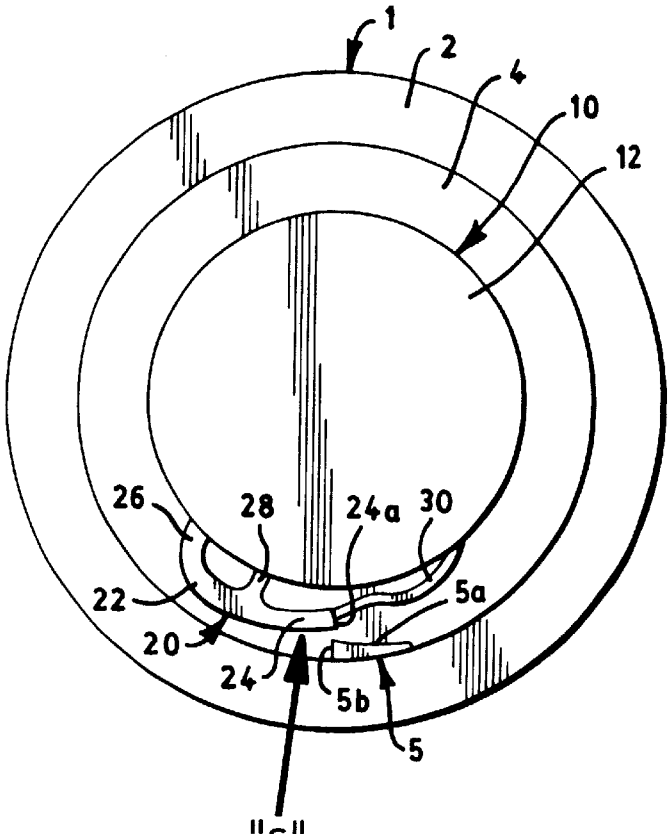
FIG. 5 is a top view of the safety closure and container neck portion of FIG. 1, wherein the safety closure is shown in an unlocked, partially-unthreaded, position on the container neck portion.
Figure 4:
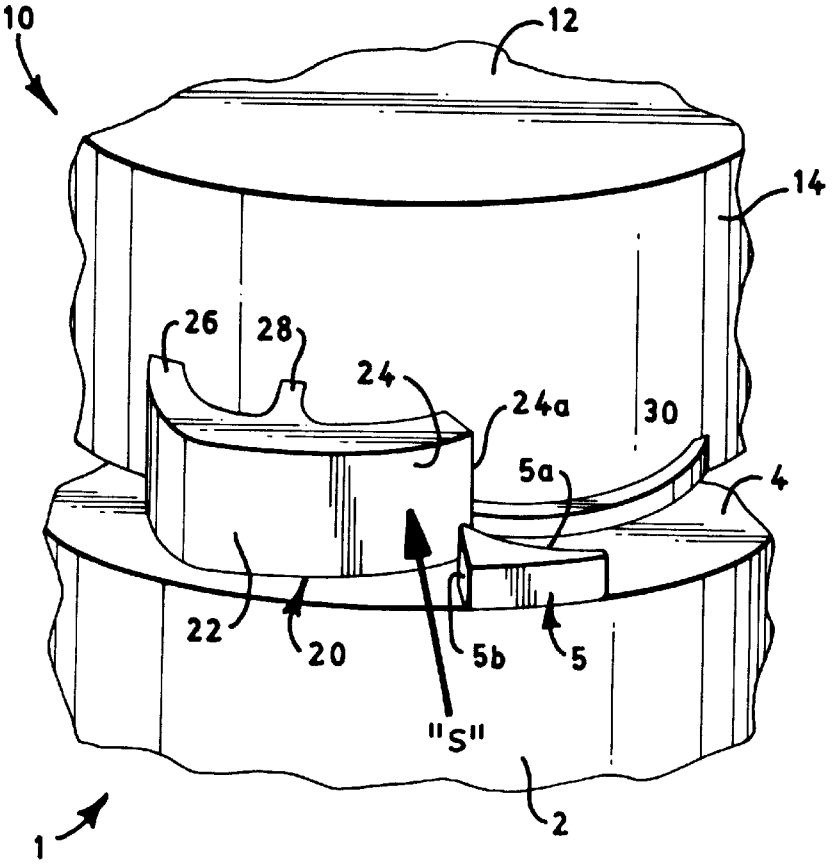
FIG. 4 is a fragmentary perspective view of the safety closure and container neck portion of FIG. 1, wherein the safety closure is shown in an unlocked, partially-unthreaded, position on the container neck portion.

With additional reference to FIGS. 2 and 3, the safety closure 10 is threadingly affixable to the container 1 a sufficient distance to permit the locking tab 20 to pass annularly behind the lock abutment 5. The locking tab 20 includes an anchored end 22 integrally connected to the side wall 14 and a free end 24 connected to the side wall 14 by a resilient biasing strap 30. The biasing strap 30 cooperates with the resiliency of the locking tab 20 to bias the free end 24 of the locking tab 20 in a normally-outward position, such as is shown in FIGS. 1–3. Depressing the free end 24 of the locking tab 20, such as, for example, by the user's squeezing the locking tab 20 towards the side wall 14 between the thumb and fingers of one hand, displaces the free end 24 inwardly towards the side wall 14 accordingly, such as is shown in FIGS. 4 and 5. Once the user ceases depressing the free end 24 of the locking tab 20, the biasing strap 30 urges the free end 24 back to the first, outward position, such as is shown in FIGS. 1–3.

The anchored end 22 of the locking tab 20 is connected to the side wall 14 at at least two locations thereon. Preferably, a first rib 26 connects a proximal end of the locking tab 20 to the side wall 14 and a second rib 28 connects an intermediate portion of the locking tab 20 to the side wall 14 at a location spaced from the anchored end 22 of the locking tab towards the free end 24 thereof but not beyond a midpoint thereof.

The safety closure 10 is threaded onto the container neck portion 3 until an outer surface of the locking tab 20 abuts the ramped face 5*a* of the container lock abutment 5. Additional rotation of the safety closure 10 causes the free end 24 of the locking tab 20 to slide inwardly along the ramped surface 5*a* of the lock abutment 5, thereby deflecting the free end 24 of the locking tab 20 towards the closure side wall 14 and against the outward bias of the biasing strap 30. Once the safety closure 10 has been threaded onto the container neck portion 3 a sufficient distance such that the free end 24 of the locking tab 20 has passed annularly behind the lock abutment 5, the free end 24 snaps outwardly back into the outward position, seated behind the abutment face 5*b* of the lock abutment 5. Removal rotation and unthreading of the safety closure 10 from the container neck portion 3 is prevented by the engagement of a flattened portion 24*a* of the free end 24 of the locking tab 20 against the abutment face 5*b* of the container lock abutment 5.

With reference to FIGS. 4 and 5, and in response to the user's applying an inwardly-directed squeezing force "S" thereto, the free end 24 of the locking tab 20 is displaceable towards the closure side wall 14 against the outward bias of the biasing strap 30 a sufficient distance to permit the flattened portion 24*a* of the locking tab free end 24 to be positioned radially inwardly of the container lock abutment 5. The closure 10 may then be unthreaded from the container neck portion 3, wherein the closure tab 20 will pass inwardly of the container lock abutment 5, rather than seating thereagainst. Once the closure tab 20 has been rotated annularly in front of the container neck portion lock abutment 5, the squeezing force "S" may be removed from the tab 20. The natural resiliency of the locking tab 20 cooperates with the biasing strap 30 to urge the free end 24 of the locking tab 20 back to the outward position. Additional unthreading of the closure 10 will lift the locking tab 20 axially above the lock abutment 5 a sufficient distance during one rotation of the closure 10 such that the locking tab 10 will pass over the lock abutment 5 and not be seated thereagainst during subsequent removal rotations of the closure 10.

The second rib 28 stiffens the locking tab 20 and prevents damage thereto as a result of a tampering force applied outwardly thereto in a direction substantially opposed to the squeezing force "S". For example, the second rib 28 prevents the free end 24 of the locking tab 20 from being pulled far enough away from the closure side wall 14 to either break the biasing strap 30, stretch the locking tab 20 a sufficient distance to defeat the locking features as described herein, or break the locking tab 20 free from the safety closure 10 altogether.

Distortion of the locking tab 20 during molding thereof in a molding die (not shown) is also minimized by the second rib 28. More particularly, as the closure 10 is being removed from the mold cavity of the molding die, the closure 10 typically tends to stick to the molding surfaces of the molding die mold cavity. The second rib 28 resists upward flexure of the free end 28 of the locking tab 20 substantially in the direction indicated generally in the Figures by reference letter "F" during removal of the closure 10 from the molding die, thereby preventing upward distortion or permanent warping thereof.

Figure 7:
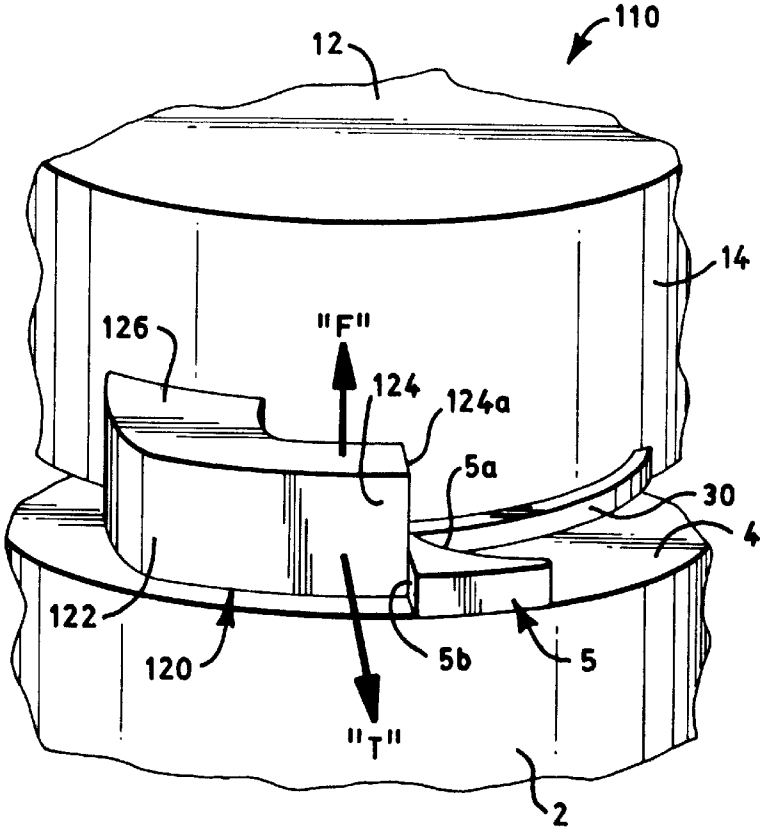
FIG. 7 is a fragmentary view of the safety closure of FIG. 6, wherein the safety closure is shown in a locked, fully-threaded, position on the container neck portion of FIG. 1.
Figure 6:
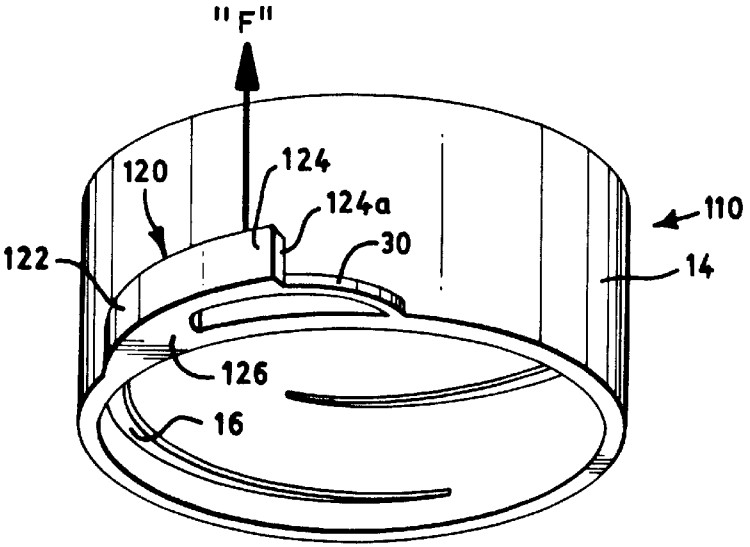
FIG. 6 is a perspective view of a safety closure according to an alternative embodiment of the present invention.
Figure 9:
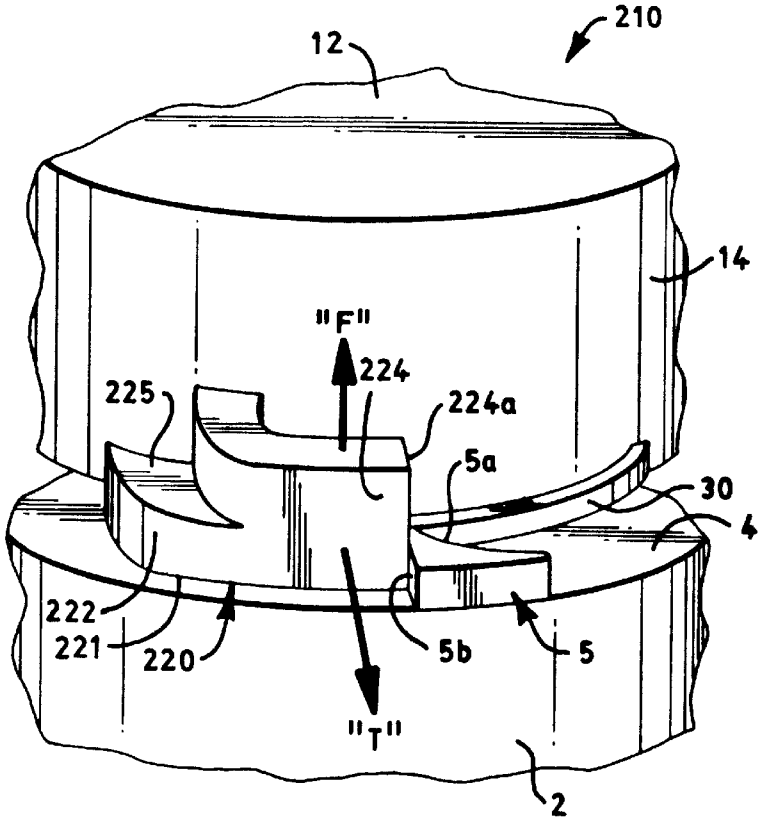
FIG. 9 is a fragmentary view of the safety closure of FIG. 8, wherein the safety closure is shown in a locked, fully-threaded, position on the container neck portion of FIG. 1.
Figure 8:
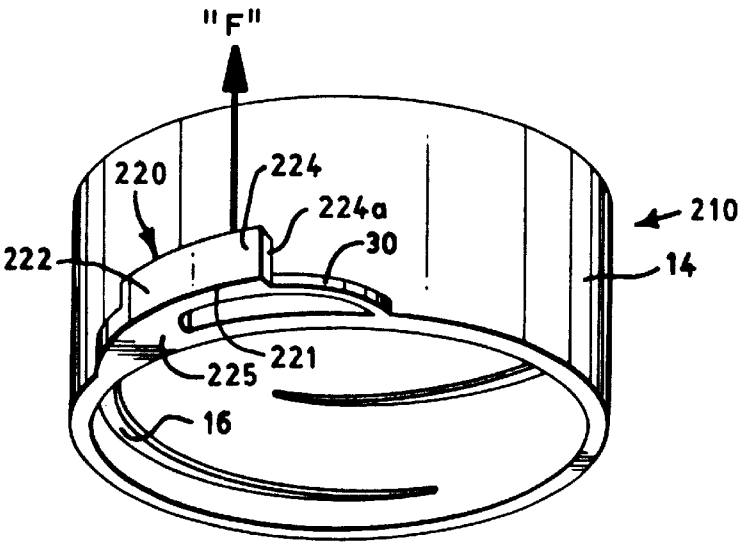
FIG. 8 is a perspective view of a safety closure according to another alternative embodiment of the present invention.
Figure 11:
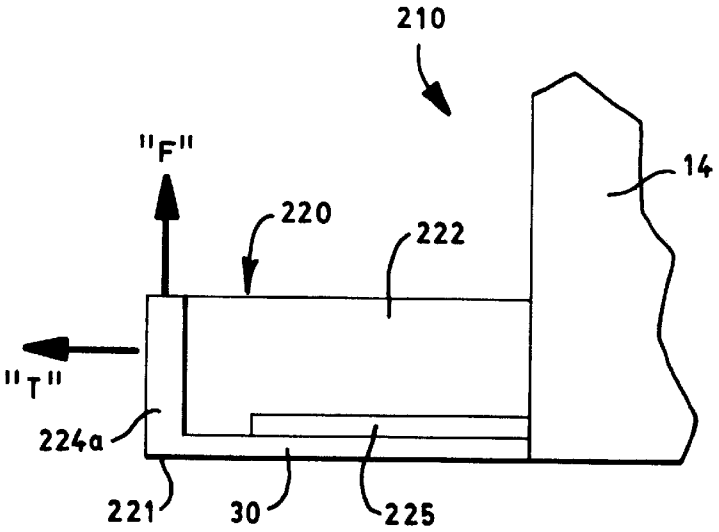
FIG. 11 is a fragmentary side view of the safety closure of FIG. 8.
Figure 12:
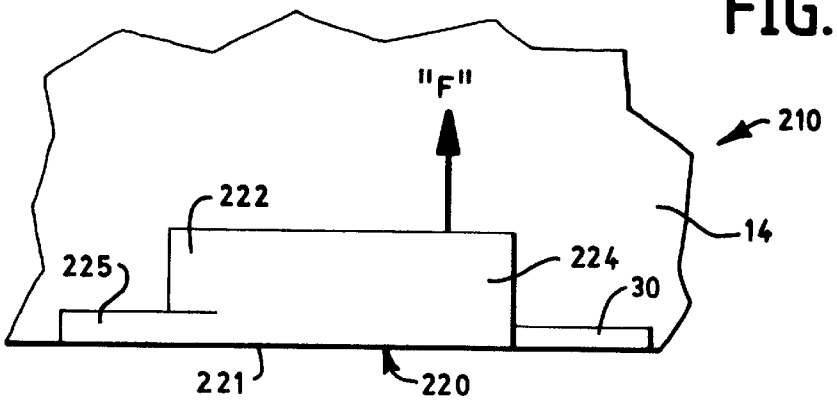
FIG. 12 is a fragmentary front view of the safety closure of FIG. 8.
Figure 10:
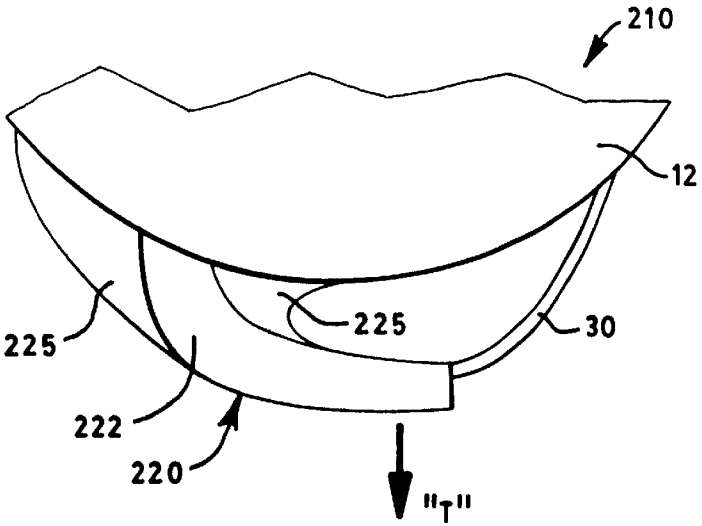
FIG. 10 is a fragmentary top view of the safety closure of FIG. 8.

With reference to FIGS. 6 and 7, a safety closure 110 according to an alternative embodiment of the present invention includes many components in common with the safety closure 10 according to the preferred embodiment hereof and like reference numerals are intended to represent like components. However, the safety closure 110 according to the present embodiment includes a locking tab 120, wherein the first and second ribs 26, 28, respectively, of the locking tab 20 according to the preferred embodiment hereof have been merged into one continuous base portion rib 126 located at the anchored end 122 of the locking tab 120 to integrally connect the locking tab 120 to the closure side wall 14. The base portion rib 126 stiffens the locking tab 120, thereby resisting upward flexure movement "F" when the closure 120 is being removed from the molding cavity (not shown), and also resisting outward movement "T" due to the user's pulling the locking tab free end 124 away from the closure side wall 14.

With reference to FIGS. 8–12, a safety closure 210 according to another alternative embodiment of the present invention includes many components in common with the safety closure 10 according to the preferred embodiment hereof and like reference numerals are intended to represent like components. However, the closure 210 according to the present embodiment includes a locking tab 220 having a stiffening platform 225 extending outwardly from opposed sides of an anchored end 222 of the locking tab 220 and connecting a bottom end 221 of the locking tab 220 to the closure side wall 14. The stiffening platform 225 is positioned towards the bottom end 221 of the locking tab 220 and extends upwardly therefrom towards the top end 223 but not beyond a midpoint thereof. Thus, the free end 224 of the locking tab 220 remains sufficiently flexible to permit inward displacement thereof to overcome the container lock abutment 5 as described herein, but resists upward flexure thereof in the "F" direction during removal of the closure 220 from the molding cavity and further resists outward tampering movement thereof in the "T" direction by the user.

With reference to FIGS. 13–18, a safety closure 310 according to another alternative embodiment of the present invention includes many components in common with the safety closure 10 according to the preferred embodiment hereof and like reference numerals are intended to represent like components. However, the safety closure 310 according to the present embodiment includes a locking tab 320 which is connected to the closure side wall 14 by a flexible spring web 325. The spring web 325 is substantially continuous and is sufficiently flexible to permit upward bowing thereof when a free end 324 of the locking tab 320 is moved towards the closure side wall 14 as described herein.

Figure 13:
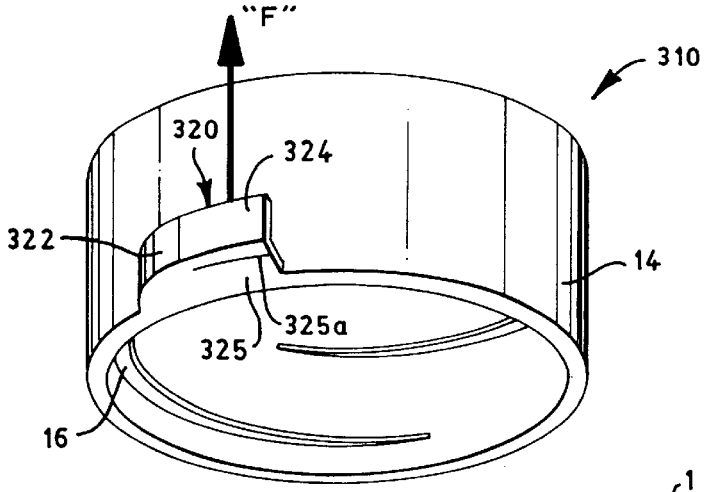
FIG. 13 is a perspective view of a safety closure according to another alternative embodiment of the present invention, wherein a locking tab of the safety closure is shown in an outward position.
Figure 14:
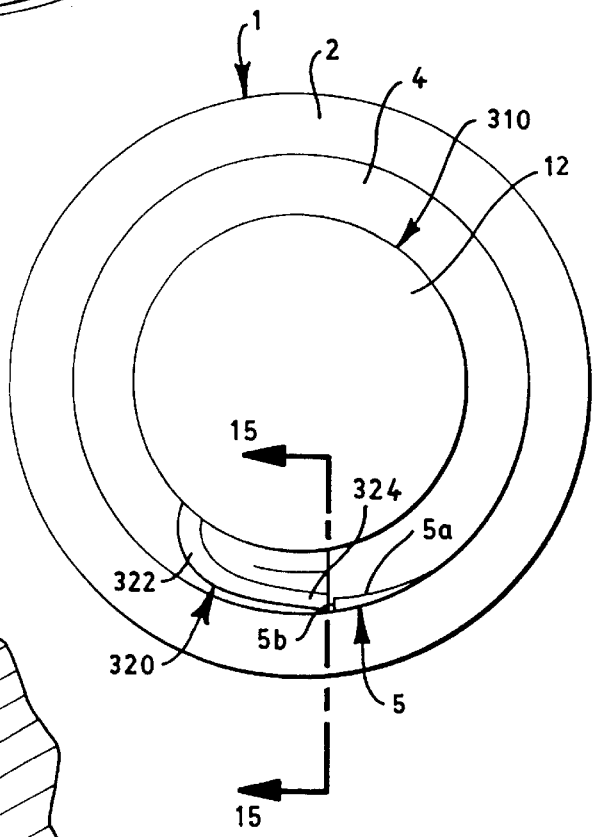
FIG. 14 is a top view of the safety closure of FIG. 13, wherein the safety closure is shown in a locked, fully-threaded, position on the container neck portion of FIG. 1.
Figure 15:
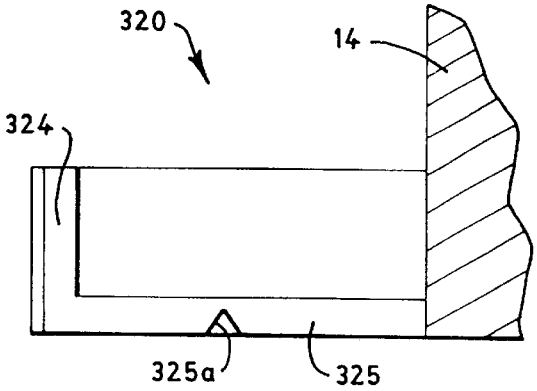
FIG. 15 is a fragmentary section view of the safety closure of FIG. 13, shown along section line 15—15 of FIG. 14.
Figure 16:
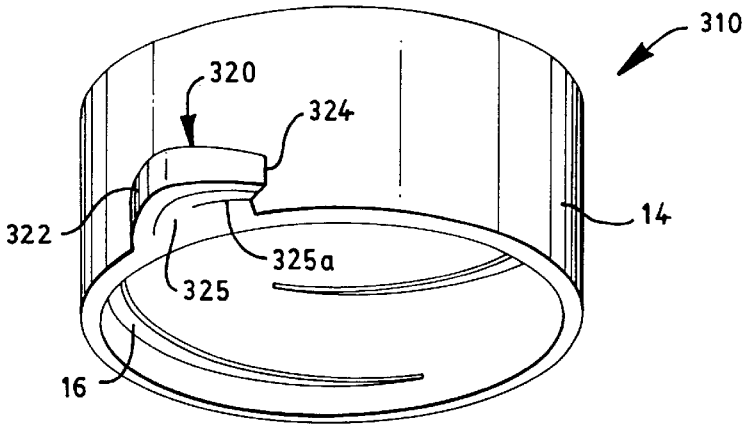
FIG. 16 is a perspective view of a safety closure of FIG. 13, wherein the locking tab of the safety closure is shown in a depressed position.
Figure 17:
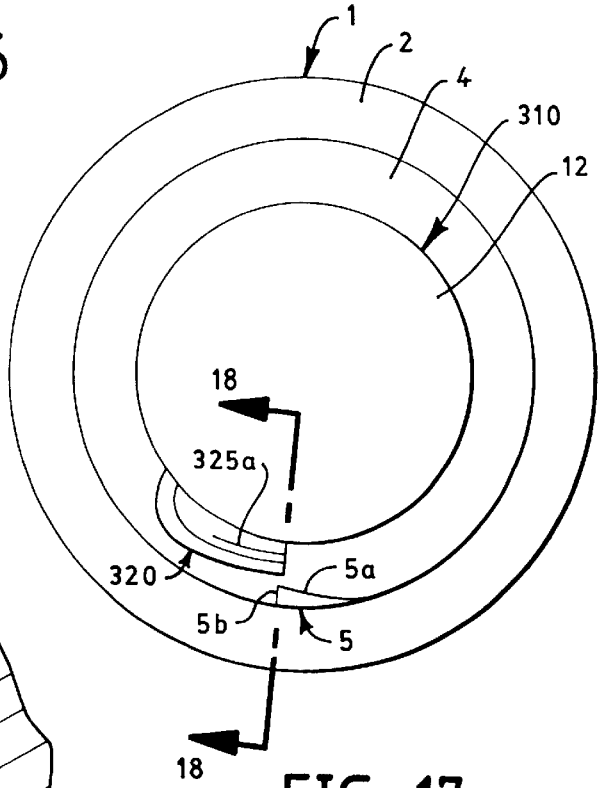
FIG. 17 is a top view of the safety closure of FIG. 16, wherein the safety closure is shown in an unlocked, partially-unthreaded, position on the container neck portion of FIG. 1.
Figure 18:
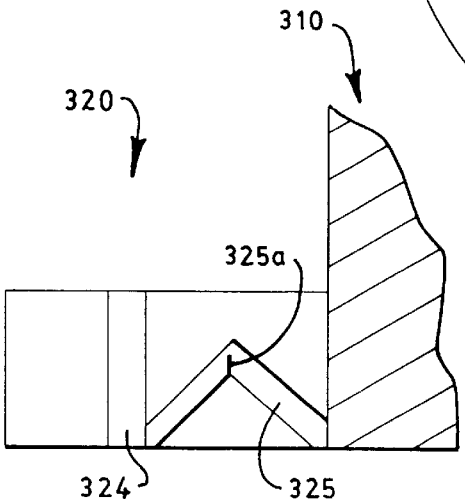
FIG. 18 is a fragmentary section view of the safety closure of FIG. 16, shown along section line 18—18 of FIG. 17.

Under normal, unstressed, conditions, the spring web 325 forces the free end 324 of the locking tab 320 into the outward position, as is shown generally in FIGS. 13–15. However, upon depressing the free end 324 inwardly towards the closure side wall 14, the spring web 325 bows upwardly, such as is shown generally in FIGS. 16–18, thereby permitting the free end 324 to pass inwardly of the container lock abutment 5 as described herein. Upon releasing the inwardly-directed squeezing force, the natural resiliency of the spring web 325 urges the free end 324 of the locking tab 320 back to the outward position.

The spring web 325 may be provided with a weakened line 325*a* spaced midway between the locking tab 320 and the closure side wall 14 to enhance the upward bowing of the spring web 325 upon inward movement of the free end 324 of the locking tab 320. The weakened line 325*a* may be an inverted bevel, such as is shown in the Figures; however, the weakened line 325*a* may have any other suitable form which enhances the upward bowing of the spring web 325 as described herein. The spring web 325 reinforces the locking tab 320 to resist outward tampering therewith to tear the locking tab 320 from the safety closure 310 as discussed herein. The spring web 325 further reinforces the locking tab 320 to inhibit distortion thereof during removal from the molding die as described herein.

The spring web 325 further assists during formation of the safety closure 310 by connecting the formation chambers (not shown) of the molding die which define the closure side wall 14 and the locking tab 320. When no such spring web 325 is provided, liquid closure material must pass to the free end 324 of the locking tab 320 by traveling along its entire length, thereby increasing the occurrence of air pockets trapped therein. However, when the spring web 325 is provided, liquid closure material may pass transversely from the closure side wall formation chamber (not shown), through the spring web formation chamber (not shown) and into the locking tab formation chamber (not shown), thereby lessening the occurrence of air pockets trapped therein.

Figure 20:
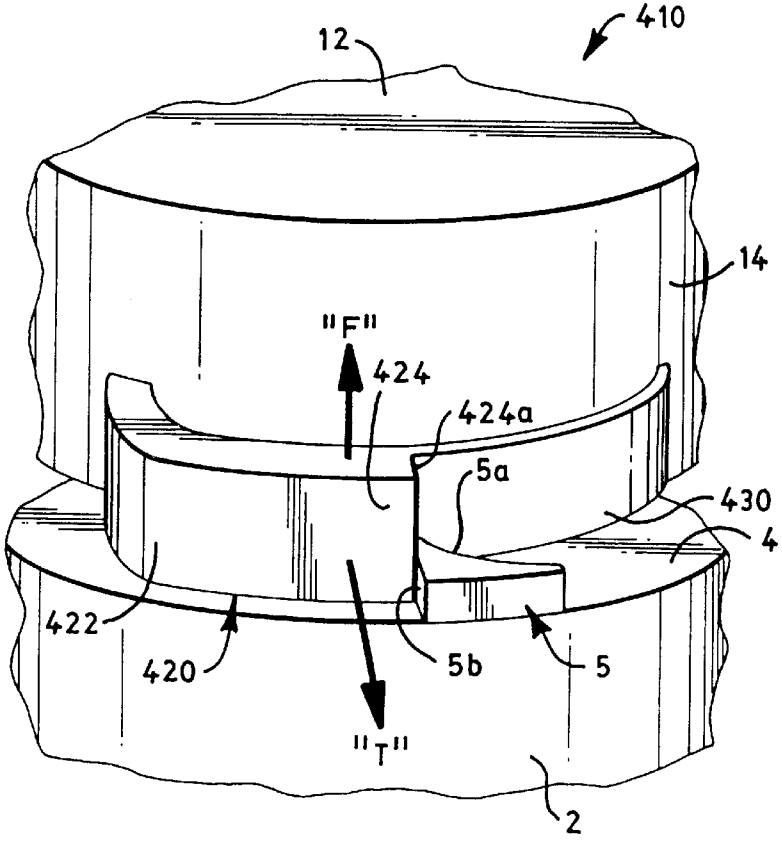
FIG. 20 is a fragmentary view of the safety closure of FIG. 19, wherein the safety closure is shown in a locked, fully-threaded, position on the container neck portion of FIG. 1.
Figure 19:
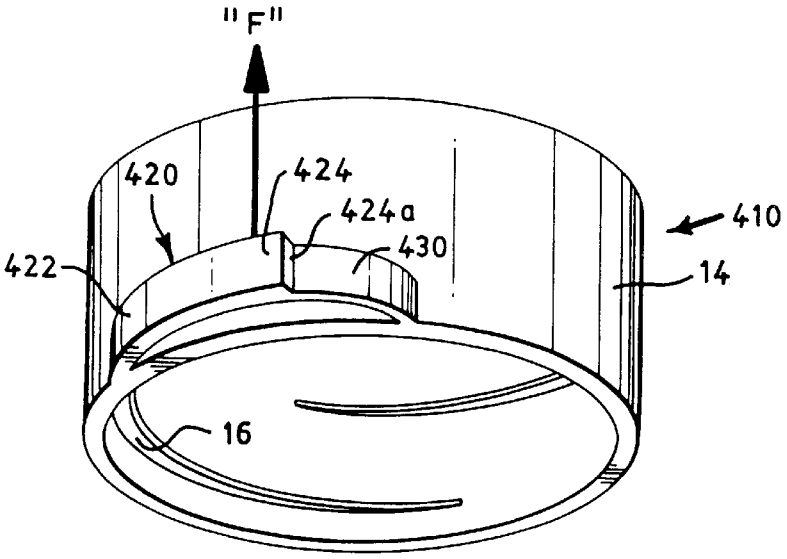
FIG. 19 is a perspective view of a safety closure according to another alternative embodiment of the present invention.

With reference to FIGS. 19 and 20, a safety closure 410 according to another alternative embodiment of the present invention includes many components in common with the safety closure 10 according to the preferred embodiment hereof and like reference numerals are intended to represent like components. However, the safety closure 410 according to the present embodiment includes a locking tab 420 having a tall biasing strap 430 which extends upwardly continuous with the locking lug free end 424, thereby reinforcing the locking lug 420 and resisting distortion or damage thereto.

Figure 22:
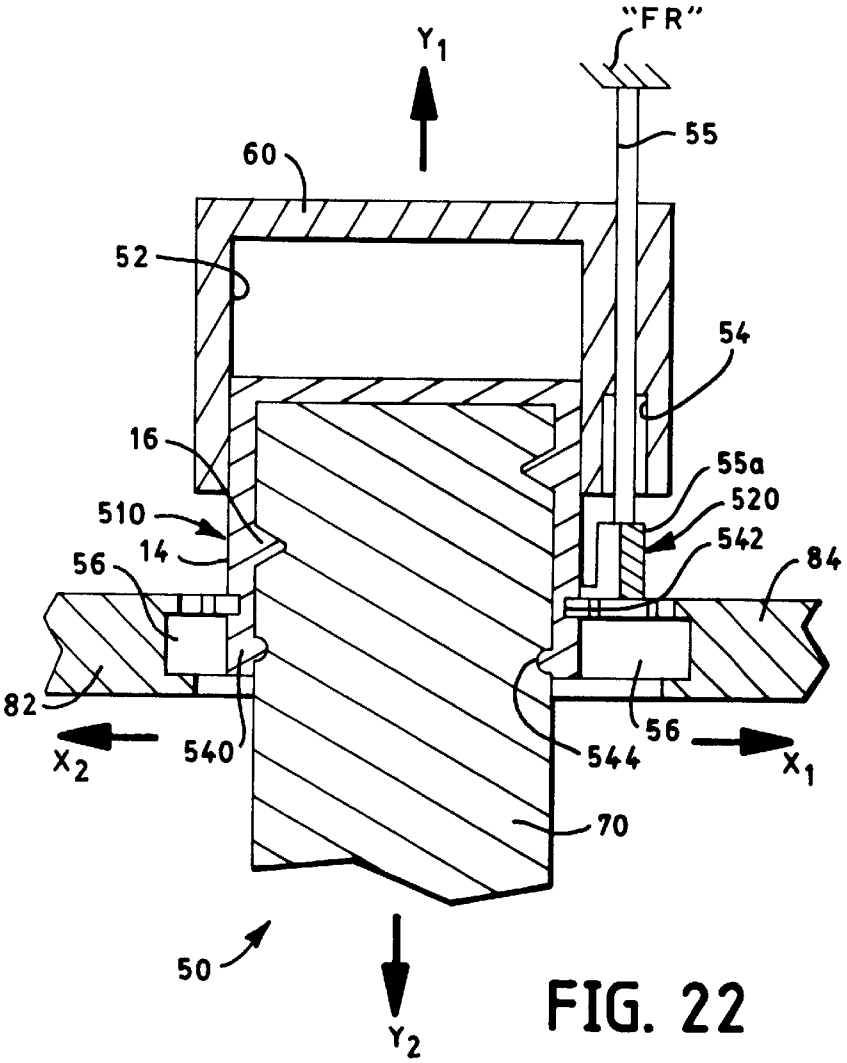
FIG. 22 is a section view of the molding apparatus of FIG. 21, wherein a safety closure according to another alternative embodiment is shown, and wherein the molding apparatus is shown in an orientation suitable for removing the safety closure therefrom; and, FIG. 23 is a perspective view of the safety closure of Figure formed by the molding apparatus of FIG. 21.
Figure 21:
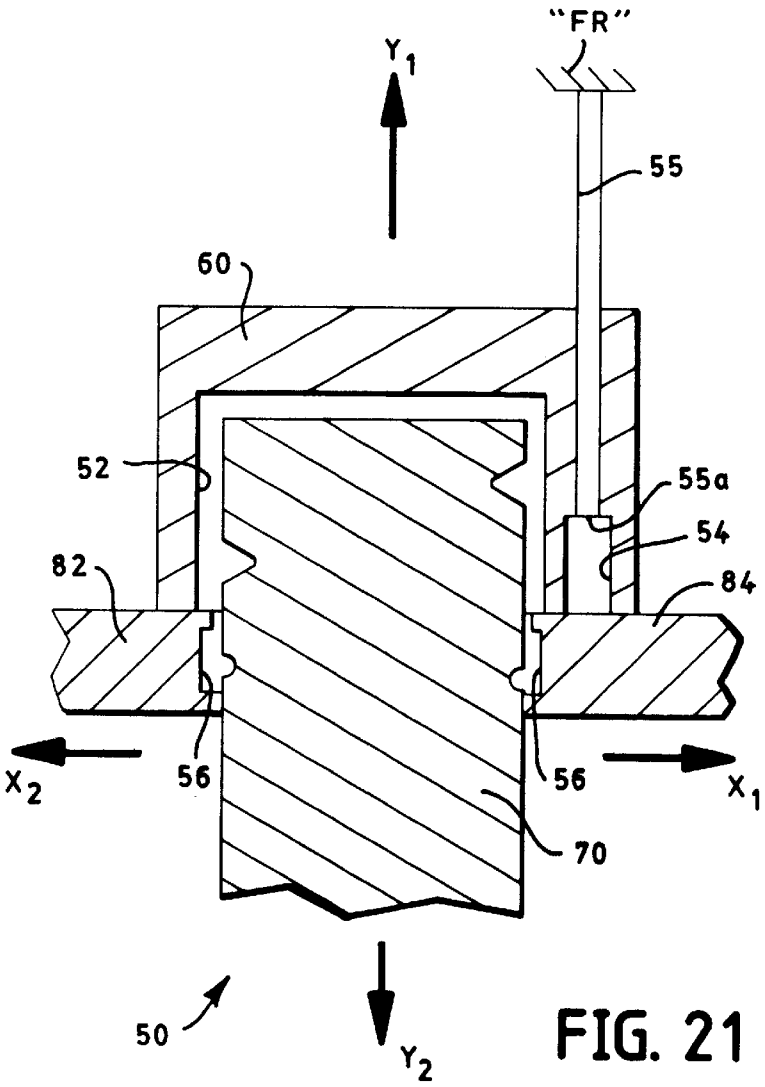
FIG. 21 is a section view of a molding apparatus according to a preferred embodiment of the present invention for forming a safety closure, wherein the molding apparatus is shown is an orientation suitable for forming the safety closure.
Figure 23:
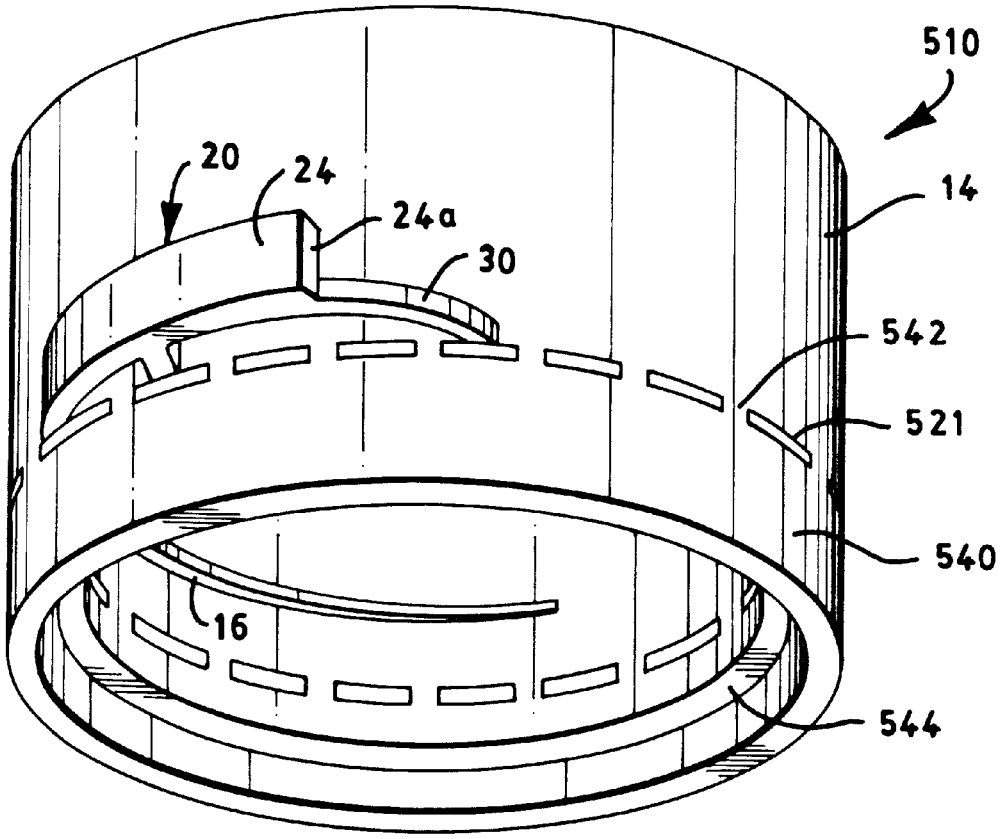

With reference to FIGS. 21–23, a molding apparatus 50 according to a preferred embodiment hereof for forming a safety closure 510 according to another embodiment of the present invention is shown. The safety closure 510 includes many components in common with the safety closure 10 according to the preferred embodiment hereof and like reference numerals are intended to represent like components. However, the safety closure 510 according to the present embodiment includes a tamper-indicating band 540 integrally-molded with the lower end 521 of the closure side wall 14 and detachably connected thereto by a plurality of annularly-spaced frangible bridge segments 542. The tamper-indicating band 540 includes a continuous retaining bead 544, or the like, which engages a bead (not shown) provided on the container neck portion 3 (FIG. 1) to retain the tamper-indicating band 540 on the container neck portion 3 once the safety closure 510 has been threadingly affixed to the container neck portion 3 a first time. Removal of the safety closure 510 from the container neck portion 3 a first time breaks the frangible bridge segments 542 between the closure side wall 14 and the tamper-indicating band 540, and permits removal of the cap portion of the safety closure 510 from the container neck portion 3 independently from the tamper-indicating band 540, which remains affixed to the container neck portion 3 to provide evidence that the container 1 has been opened at least a first time. Alternatively, the tamper-indicating band 540 may be provided with other retaining means, for example, a plurality of annularly-spaced flexible fingers (not shown), or a continuous annular folding flange (not shown) which engages the bead on the container neck portion to prevent removal of the tamper-indicating band 540 therefrom once the safety closure 510 has been affixed to the container neck portion 3 a first time.

The molding apparatus 50 includes an upper die 60 reciprocally moveable in directions $y_1$, $y_2$, a lower core 70 reciprocally moveable in directions $y_1$, $y_2$ to be receivable within the upper die 60, and first and second band-forming collars 82, 84, each collar being reciprocally moveable in directions $x_1$, $x_2$. The upper die 60 and the band-forming collars 82, 84 are positionable around the lower core 70, and spaced therefrom, to define a closure-forming chamber 52 therearound, to define a locking tab-forming chamber 54 spaced outwardly from the closure-forming chamber 52, and to define a band-forming chamber 56 connected to the closure-forming chamber 52 and spaced therebelow, as shown generally in a "mold-closed" position in FIG. 21.

A hold-down pin 55 passes downwardly through the upper die 60 and is slidably moveable therein such that, as the upper die 60 reciprocates in directions $y_1$, $y_2$, the hold-down pin 55 remains stationary relative thereto, and relative to a closure 510 which may have been formed therein. A distal end 55*a* of the hold-down pin 55 completes an upper molding surface of the locking tab-forming chamber 54 when the molding apparatus is in the "mold-closed"

position, thereby permitting formation of the locking tab 520 therein. However, the hold-down pin 55 maintains the position of the locking tab 520 relative to the formed closure 510 while the upper die 60 is moving in direction $y_1$ during removal of the closure 510 from the upper die 60, thereby preventing upward warping of the locking tab 520 due to the locking tab 520 sticking to the molding surfaces of the locking tab-forming chamber 54.

A closure 510 is formed using the molding apparatus 50 according to the preferred embodiment hereof as described below. The upper die 60 is moved in direction $y_2$ into the "mold-closed" position, the lower core 70 is moved in direction $y_1$ into the "mold-closed" position, thereby defining the closure-forming chamber 52, and the first and second band forming collars 82, 84, respectively, are moved in directions $x_1$ and $x_2$, respectively, into the "mold-closed" position beneath the upper die 60 to complete closure-forming chamber 52, the locking tab-forming chamber 54 and the band-forming chamber 56. Liquid closure material is then injected into the chambers 52, 54, 56, which are each in fluid communication with one another, and permitted to set to a preselected pliability. First and second band-forming collars 82, 84, respectively, are then moved in directions $x_2$ and $x_1$, respectively, to be a sufficient distance away from the formed closure 510 to permit removal of the formed closure 510 from the molding apparatus 50. The upper die 60 is moved in direction $y_1$, while the formed closure 510 remains affixed to the molding core 70, typically due to the thread 16 formed therein, thereby removing the formed closure 510 from the upper die 60. While the upper die 60 moves in direction $y_1$, the hold-down pin 55 maintains the formed locking tab 520 in the proper position relative to the formed closure 510 to prevent warping or other distortion of the locking tab 520. Once the upper die 60 has been moved sufficiently away from the formed closure 510 such that the formed closure 510, including the locking tab 520 are no longer in their respective forming chambers 52, 54, the lower core 70 is moved in direction $y_2$ to a location where the formed closure 510 can be unthreaded therefrom.

Although the present invention has been described in terms of specific embodiments which are set forth in detail, it should be understood that this is by illustration only and that the present invention is not necessarily limited thereto, since alternative embodiments not described in detail herein will become apparent to those skilled in the art in view of the disclosure. Accordingly, modifications are contemplated which can be made without departing from either the spirit or the scope of the present invention as described hereinabove.

We claim:

1. A safety closure, comprising:

a top wall;

a side wall depending from said top wall; and, a locking tab projecting outwardly from said side wall, said locking tab having a first rib extending radially from said side wall connecting a proximal end of said locking tab to said side wall, a second rib extending radially from said side wall connecting an intermediate portion of said locking tab to said side wall, and a biasing strap connecting a free end of said locking tab to said side wall.

2. The safety closure of claim 1, wherein said first and second rib are joined to form a base portion rib which includes a stiffening platform portion extending outwardly from opposed sides of said proximal end of said locking tab and connecting a bottom end of said locking tab to said closure side wall.

3. A safety closure, comprising:

a top wall;

a side wall depending from said top wall; and, a locking tab projecting outwardly from said side wall, said locking tab having a first rib extending radially from said side wall connecting a proximal end of said locking tab to said side wall, said locking tab having a second rib extending radially from said side wall connecting an intermediate portion of said locking tab to said side wall, said safety closure including a detachable band integrally connected to a lower end of said side wall by a plurality of bridge segments.

4. The safety closure of claim 3, said locking tab including a biasing strap connecting a free end of said locking tab to said side wall.

5. The safety closure of claim 3, said first and second rib are joined to form a continuous rib including a stiffening platform portion extending outwardly from opposed sides of said proximal end of said locking tab and connecting a bottom end of said locking tab to said closure side wall.

6. The safety closure of claim 3, said first and second rib are joined to form a continuous rib and further including a spring web portion extending from said base portion rib toward said free end of said locking tab on a bottom end thereof, said spring web portion extending towards said free end of said locking tab and connecting said side wall with said locking tab, said spring web compressively collapsible between said locking tab and said closure sidewall.

7. A safety closure, comprising:

a top wall;

a side wall depending from said top wall;

a locking tab projecting outwardly from said side wall, said locking tab having a first rib extending radially from said side wall connecting a proximal end of said locking tab to said side wall;

a second rib extending radially from said side wall connecting an intermediate portion of said locking tab to said side wall;

a biasing strap connecting a free end of said locking tab to said side wall; and a stiffening platform along a bottom portion of said locking tab connecting said bottom portion of said locking tab with said side wall.

8. A safety closure, comprising:

a top wall;

a side wall depending from said top wall; and, a locking tab projecting outwardly from said side wall, said locking tab having a first rib extending radially from said side wall connecting a proximal end of said locking tab to said side wall, a second rib extending radially from said side wall connecting an intermediate portion of said locking tab to said side wall, and wherein said first and second rib are joined to form a base portion rib, said, safety closure further includes a spring web portion extending from said base portion rib toward said free end of said locking tab on a bottom end thereof, said spring web portion extending towards said free end of said locking tab and connecting said side wall with said locking tab, said spring web compressively collapsible between said locking tab and said closure sidewall.

9. The safety closure of claim 8, wherein said spring web includes a weakened portion thereof.

* * * * *